United States Patent [19]

Field et al.

[11] Patent Number: 4,858,670

[45] Date of Patent: Aug. 22, 1989

[54] METHOD OF MAKING AND APPARATUS FOR MONOBLOCK ENGINE CONSTRUCTION

[75] Inventors: Nathaniel L. Field, Northville; Michael A. Pulick, Livonia, both of Mich.

[73] Assignee: Ford Motor Company, Dearborn, Mich.

[21] Appl. No.: 137,771

[22] Filed: Dec. 24, 1987

[51] Int. Cl.[4] ..... B22D 19/16

[52] U.S. Cl. ..... 164/11; 164/98

[58] Field of Search ..... 164/9, 10, 11, 98, 99, 164/101, 102, 103, 369

[56] References Cited

U.S. PATENT DOCUMENTS

| | | | |
|---|---|---|---|
| 2,978,764 | 4/1961 | Hrabovsky | 164/9 |
| 3,521,613 | 9/1968 | Celli . | |
| 3,965,961 | 6/1976 | Gunnergaard | 164/200 |
| 4,077,458 | 3/1978 | Hayashi et al. | 164/11 |
| 4,252,175 | 2/1981 | Whipple . | |

OTHER PUBLICATIONS

SAE 710150 "Vega 2300" by Reuss et al, 1971, p. 22.

SEA 307C "Chrysler Corporation's Die-Cast Aluminum Slant Six Engine", by Moeller et al, 1961, pp. 5–11.

*Primary Examiner*—Kuang Y. Lin

*Attorney, Agent, or Firm*—Joseph W. Malleck; Roger L. May

[57] ABSTRACT

A method of making a cast dual-metal monoblock, by (i) casting an iron-based insert to define walls for one or more chambers or passages for each of combustion, piston reciprocation, gaseous induction and gaseous exhaust; (ii) forming a sand core wrapping directly about said insert to cover such insert except for the extremities of the walls defining the passages for gaseous induction and exhaust and the chamber for piston reciprocation, such extremities being remote form the walls defining the combustion chamber; and (iii) die casting an aluminum-based metal jacket about the assembly of said insert and core wrapping to complete the dual-metal monoblock. Advantageously, in step (ii), there is further included the formation of a top sand core assembly for defining one or more oil and/or valve train passages or chambers, the top sand core assembly being stationed to rest on the insert during casting of the jacket.

5 Claims, 2 Drawing Sheets

METHOD OF MAKING AND APPARATUS FOR MONOBLOCK ENGINE CONSTRUCTION

BACKGROUND OF THE INVENTION

1. Technical Field

This invention relates to the art of making engine housings and combustion chambers for internal combustion engines and, more particularly, to the art of making a unitary block for the combustion chamber, sometimes referred to as a monoblock.

2. Description of the Prior Art

There has been a longstanding need and desire to make cylinder blocks and heads for internal combustion engines out of materials lighter than the traditional cast iron. One of the earliest and best-known commercial attempts to reduce weight of the engine was the use of an all-aluminum cylinder block (see SAE 710150 "Vega 2300" by Reuss and Hughes, 1971, page 22). To increase the wear resistance of the cylinder bore surface of the Vega block, a special high-silicon alloy was employed which required etching of the bore surface to expose silicon particles for the enhancement of wear resistance when working against pistons.

Other attempts at the deployment of aluminum in the housing of internal combustion engines have included the use of cast-in-place iron liners suited for the use of aluminum pistons and accompanied by the use of separate cast iron heads (see SAE 307C "Chrysler Corporation's Die-Cast Aluminum Slant 6 Engine", by Moeller et al, 1961, pages 5–11). Again, this disclosure was limited by the use of separate heads and blocks, requiring reinforcing means to join the members together at a gasketed parting plane.

Monoblock engine designs have been envisioned to eliminate such weight increases resulting from reinforcement to join separate head and blocks, and to better control the thermal gradients in the combustion chamber. No attempt is known which clearly discloses the use of aluminum as the material for the monoblock principal housing, but it can be assumed that in U.S. Pat. Nos. 3,521,613 and 4,252,175 the disclosures of a die casting method for making a monoblock engine may comprehend the use of aluminum. In each of these disclosures, only a thin iron liner is employed as a bearing surface for the reciprocating pistons, with the die-cast material acting as the principal material for defining most of the combustion chamber as well as the exhaust and intake passages. In the first patent, no fluid is used for purposes of cooling the engine since it is designed primarily for small two-stroke engine applications which are presumably air cooled. In the second patent, the cooling chambers are defined totally within the die-cast material, separate and independent from the iron liner.

The inventions of the above patents present significant problems. First, there can be possible delamination of the iron liner from the die-cast material of the cylinder bore, inhibiting heat transfer severely Second, the iron liner prevents direct transfer of combustion heat directly through one material to the cooling medium. As a result, there is a poorer thermal gradient through all of the walls of the engine and such gradient is nonuniform since part of the material in contact with the cooling fluid is aluminum and the other part is a composite of an iron liner and aluminum.

Accordingly, a principal object of this invention is to provide a monoblock construction and method of making same which employs (i) iron as an envelope for substantially all of the hot chambers or zones of the engine, and (ii) aluminum as a jacket. The aluminum jacket desirably should wrap a fluid cooling medium directly in contact with substantially all of the surfaces of the iron member, except for such extremities thereof which are attached to the aluminum jacket at the extremities of the jacket.

SUMMARY OF THE INVENTION

A first aspect of this invention comprises a method for making a cast dual-metal monoblock, comprising the steps of: (a) casting an iron-based insert having walls defining one or more chambers or passages for each of combustion, piston reciprocation, gaseous induction and gaseous exhaust; (b) forming a sand core wrapping directly about such insert, such wrapping covering the insert except for the extremities of the walls defining the passages for gaseous induction and exhaust and the chamber for piston reciprocation, such extremities being remote from the walls defining the combustion chamber; and (c) casting aluminum-based metal about the assembly of the insert and core wrapping to complete the dual-metal monoblock.

Preferably, the sand core is formed by blowing sand into a core box in which the insert assembly is stationed in spaced relationship to certain core box walls. Advantageously, in step (b), there is further included the formation of a top core assembly for defining one or more oil and/or valve train passages or chambers, the top core assembly being stationed to rest on top of the insert spaced from the core wrapping.

Preferably, the aluminum-based metal is die-cast about the insert and core wrapping in a manner to form a jacket having a wall thickness controlled to a tolerance of plus or minus 0.020 inches. Advantageously, the aluminum-based metal die casting encases the entire insert construction with no iron-based surfaces exposed to the exterior.

Another aspect of this invention is that of a monoblock construction, which comprises: (a) a cast internal iron-based unitary construction having walls defining one or more chambers or passages for each of combustion, piston reciprocation, gaseous induction and gaseous exhaust; and (b) a cast external aluminum-based metal construction having walls encasing the internal construction except for separation therebetween to define fluid cooling chambers, the external construction being fused to the internal construction at the extremities of the walls of the internal construction defining the passages for gaseous induction and exhaust and the chamber for piston reciprocation, the extremities being remote from the walls defining the combustion chamber.

Preferably, the internal construction has most of its walls in the thickness range of 0.06–0.15 inches and the external construction has most of its walls in the thickness range of 0.08–0.20 inches; such walls have a tolerance of plus or minus 0.02 inches. Advantageously, portions of the surfaces of the internal construction are cylindrical and are fused to the external construction along a lineal length of such cylindrical portions of about 0.35–1.5 inches.

DETAILED DESCRIPTION AND BEST MODE

The monoblock construction of this invention uses a die-cast aluminum-based jacket (outer housing) that encases an iron-based insert forming the inner walls of the dual-metal construction. The aluminum and iron structures are separated to define fluid cooling chambers except for remote regions (from the combustion chamber) where such regions are fused and bonded together.

Selection of Materials

The iron-based insert is preferably a cast A-C block iron alloy, but can be any other iron material provided iron constitutes at least 50% by weight of the material selected. Such iron-based material may be selected to be stable at high temperatures and provide a hardness in the range of 140–220 BHN as cast or by heat treatment. This may include gray, ductile and abrasion resistant cast iron families.

The jacket of such construction is preferably comprised of aluminum casting alloy No. 380 containing about 8.5% Si and 3.5 Cu, but may be comprised of any other lightweight aluminum-based material which is adapted for die casting and is constituted at least 50% by weight of aluminum. Other desirable candidates for the aluminum material may include the aluminum alloys of the 319, 355, 356 and 360 families.

The materials constituting the sand cores used in the method of making such construction is preferably zircon sand, and should maintain core integrity at the temperatures experienced in casting aluminum-based material and with decomposing binders.

Iron-Based Cast Insert

Figure 1:
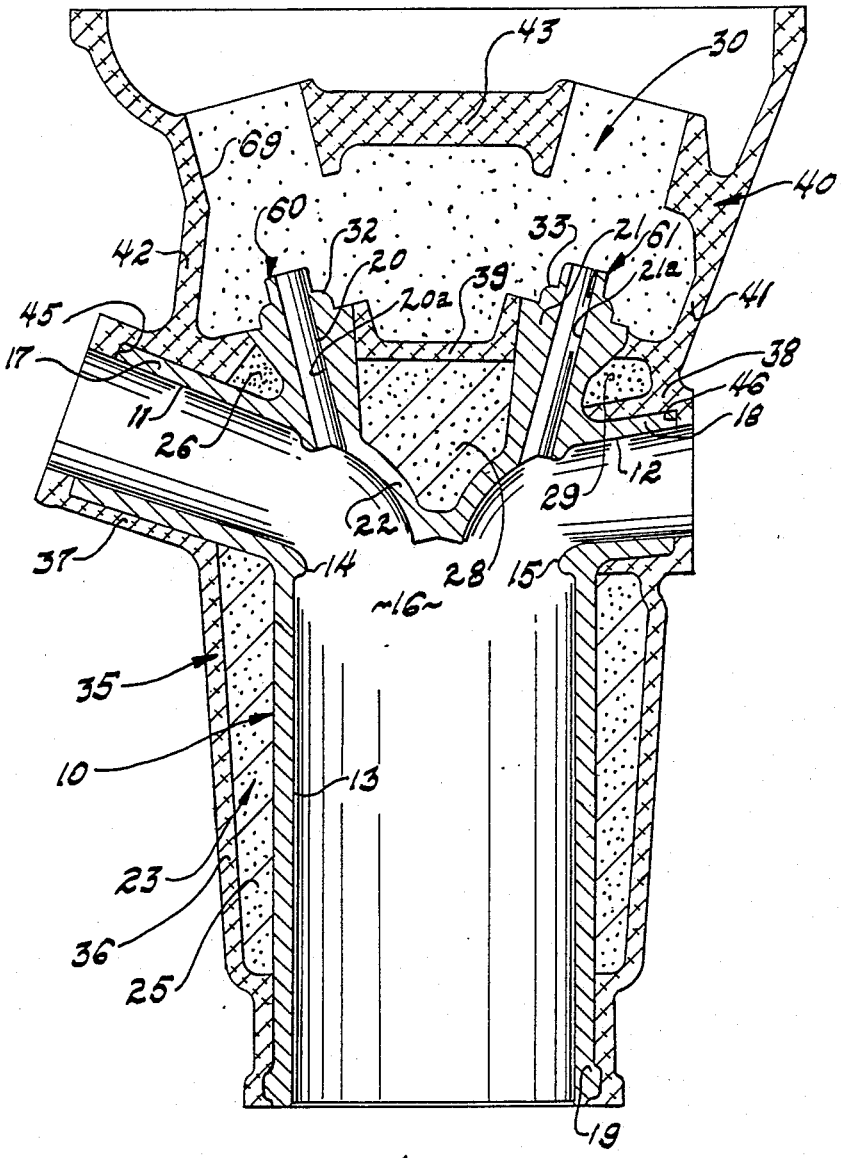
FIG. 1 is a sectional elevational view of the monoblock construction of this invention after die casting an aluminum jacket about the iron-based insert.
Figure 2:
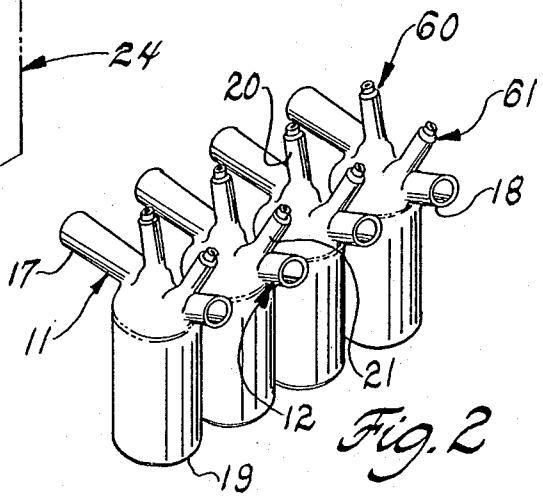
FIG. 2 is a perspective view of the iron-based insert.

As a first step in the making of the dual-metal monoblock, a casting of an iron-based insert construction is carried out to define walls for one or more chambers or passages for each of combustion, piston reciprocation, gaseous induction and gaseous exhaust. As shown in FIG. 1, the iron cast insert may define several of such chambers, such as required in an in-line engine housing having several piston chambers in line and each piston chamber being associated with intake and exhaust passages. More specifically, the casting insert 10, as shown in FIG. 1, has walls defining a gaseous induction passage 11, a gaseous exhaust passage 12, each being of a cylindrical configuration, and a piston reciprocation chamber 13 (cylinder bore), which also is of a cylindrical configuration. Each of these passages and chambers join together at a zone or juncture which facilitates definition of a combustion chamber 16. The separation between the combustion chamber 16 and the passages 11 and 12 is defined by valve seats 14 and 15 respectively.

The iron-based casting insert has extremities, which will be discussed later herein, for purposes of fusion to the aluminum die-cast outer housing. Extremities 17 and 18, respectively, are located at the ends of the intake and exhaust passages, and extremity 19 is the very lowest skirt portion of the piston reciprocation chamber. Each of these extremities are at locations remote from the combustion chamber 16 so that the temperature conditions at such locations are much lower than that at or adjacent the combustion chamber 16.

Additionally, the walls 20 of the iron-based insert are defined to provide for a valve stem guide passage **20*a* (associated with the intake passage) and walls 21 to define a valve stem guide passage 21*a* (associated with the exhaust passage). Walls 22** intermediate the intake and exhaust passages may also be defined for providing a spark ignition holder (not shown).

Sand Core Wrapping

As a second step in the process, a sand core wrapping 23 is formed directly about the iron-based insert construction 10 in a manner to cover the construction substantially except for (i) the extremities 17, 18 and 19 of the walls defining the passages for the gaseous induction and exhaust and walls defining the piston reciprocation chamber and (ii) preferably the extremities 60, 61 of the walls 20 and 21 for the valve stem guides which can act as a pedestal for an additional but independent top core assembly.

Figure 3:
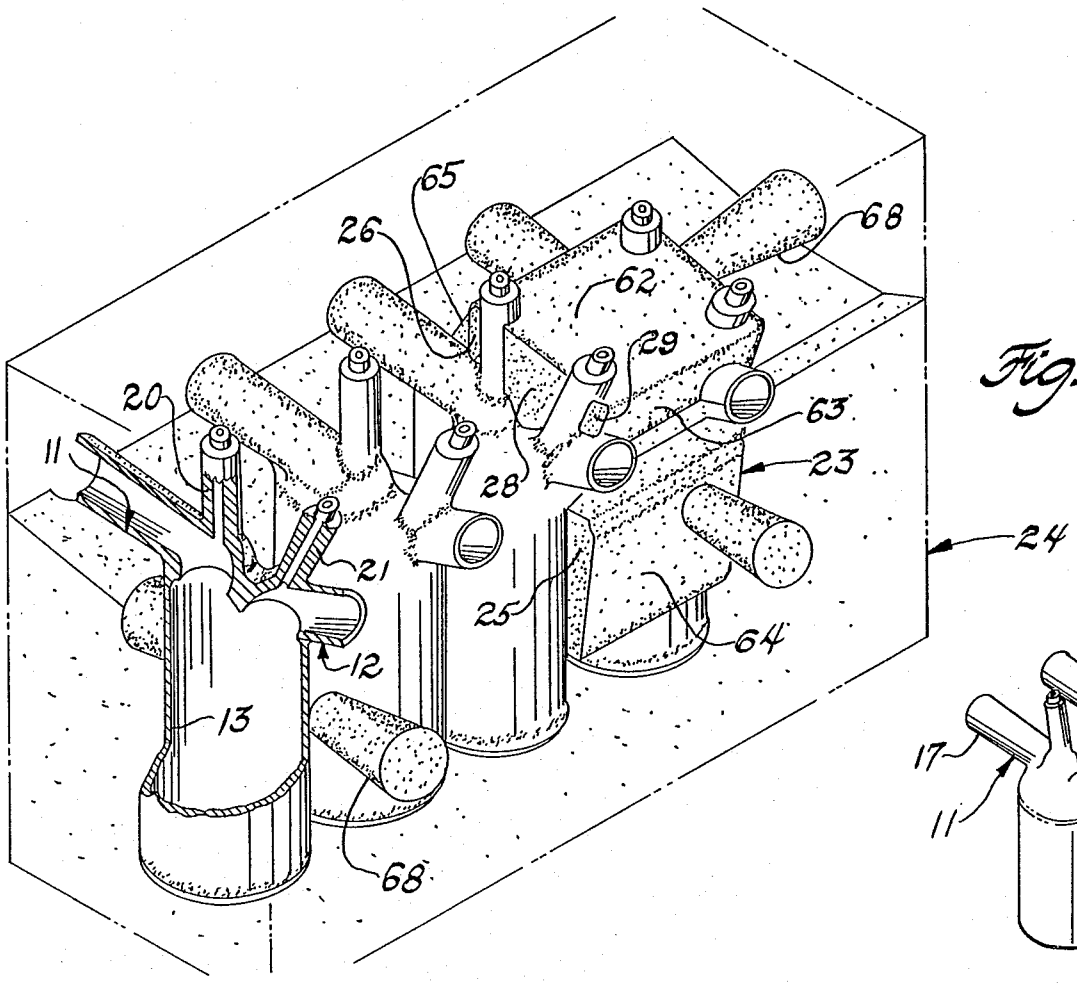
FIG. 3 is a schematic view of a core box illustrating portions of the core wrapping about the iron-based insert.

Such extremities are remote from the combustion chamber. As shown in FIG. 3, the cast iron insert 10 is supported within a core box assembly 24 having a cavity arranged to receive the insert 10 and provide a space for the core wrapping 23 thereabout. The cavity is reverse of the outer surfaces 62 (for the body of sand between the valve stem guides), surfaces 63 (for the body of sand about the exhaust passages), surfaces 64 (for the body of sand about the cylinder wall 13), and surfaces 65 (for the body of sand about the intake passage). Sand is blown into the core box assembly through entrances 68 in a manner that the space for the wrapping is fully occupied. The sand being mixed with resin binders will set and produce a rigid self-supporting wrapping about the insert. The sand wrapping will have a section 25 about the cylinder walls 13, a section 26 about the inner extent of the intake passage 11, a section 29 about the inner extent of exhaust passage 12 and a section 28 between the valve guide stem walls.

Second Sand Core Assembly

The method may further comprise the formation of a top sand core assembly 30 which is effective to define supporting walls for one or more oil galleries and/or valve train passages or chambers. This second sand core assembly is adapted to be stationed to rest directly on top of the iron-based insert at surfaces 32 and 33 of the exposed valve stem guide walls. Such top core assembly can be formed by blowing or packing resin-curable sand into another core box (not shown) having a cavity to define the top core, the walls of the cavity being complementary to the upper internal surfaces 69 of the jacket and to surfaces 32 and 33 of the valve stem guide walls.

Cast Aluminum Exterior Housing

As a final step in the method, aluminum-based metal is die-cast about the assembly of (i) the iron-based insert 10, and (ii) at least the core wrapping 23, and preferably the top core assembly 30, to complete the dual-metal monoblock. It is desirable that such aluminum casting be carried out by die casting techniques using the aluminum alloy family 380.

The aluminum exterior jacket or housing 35 is comprised of a jacket portion 36 enveloping section 25 of the core wrapping, a jacket portion 37 enveloping the exhaust passage 11 as well as the core wrapping section 26, a jacket portion 38 enveloping the exhaust passage 12, and a jacket portion 39 enveloping the sand wrapping section 28 between the valve stem guides 20 and 21. Additionally, the aluminum encasement may also provide for a valve train housing construction 40 having walls 41 and 42 extending upwardly respectively from portions 38 and 37 and walls 43 to define interior supporting walls for valve train members as well as associated oil passages.

After the aluminum metal is poured and solidified, the sand of the core wrapping 23 and top sand assembly 30 is removed through suitable openings that will be used for fluid ingress and egress of the construction.

As a result of the solidification of molten aluminum-based metal directly on extremities 17, 18 and 19, there will occur a bonding or fusion of the iron-based and aluminum-based materials. The lineal length of such cylindrical fusion interfaces should desirably be 0.35–1.5 inches. In this manner, a durable fluid-tight sealing of the chambers defined by the sand core wrapping is established. Advantageously, aluminum is encased about the ends 45 and 46 of the respective intake and exhaust passage walls so there remains no exposed surface of the cast iron insert; this not only provides for better thermal control but also provides for better finishing machining operations.

Product

The resulting dual-metal monoblock construction has an aluminum exterior which encases the entire iron-based insert leaving no portion of the iron-based insert exposed to the exterior. The aluminum die-cast exterior is fused to the iron-based insert at the extremities 17, 18 and 19 in a manner to provide a tight bond. The fused annular surfaces between the iron and aluminum extend over a lineal length of about 0.35–1.5 inches. The wall thickness for most of the walls of the aluminum die-cast exterior construction (portions 36,37,38,39) is generally in the range of 0.08–0.20 inches and is maintained in close tolerance by tight die casting techniques to be within plus or minus 0.02 inches. The iron-based internal construction has most of its walls (walls for chamber 13, and passages 14, 12 and wall 22) in the range of 0.06–0.15 inches; this is considered relatively thin for a cast construction which is facilitated by open insert casting.

While particular embodiments of the invention have been illustrated and described, it will be obvious to those skilled in the art that various changes and modifications may be made without departing from the invention, and it is intended to cover in the appended claims all such changes and modifications as fall within the true spirit and scope of the invention.

We claim:

1. A method of making a cast dual-metal unitary head and block, comprising the steps of:

(a) casting a unitary iron-based insert having continuous walls defining one or more chambers of passages for each of at least combustion, piston reciprocation, and gaseous exhaust;

(b) forming a sand core wrapping directly about said insert, said wrapping covering said insert except for the remote extremities of the walls defining said passages for gaseous exhaust and the remote extremity of the chamber for piston reciprocation, said extremities being remote from the walls defining the combustion chamber; and (c) casting alumiunum-based metal about the assembly of said insert and core wrapping to complete said dual-metal unitary block and head.

2. The method as in claim 1, in which said insert defines all of the higher temperature chambers and passages for a multicylinder engine, and said core wrapping is formed by blowing sand into a core box in which said iron-based insert is stationed in spaced relation to the core box walls.

3. The method as in claim 1, in which step (b) further includes forming a top core assembly for defining one or more oil and/or valve train passages or chambers, said top core assembly being stationed to rest on said iron-based insert during step (c).

4. The method as in claim 1, in which in step (c) said casting is carried out by die-cast techniques.

5. The method as in claim 1, in which said cast aluminum encases the entire iron-based insert with no exposed surfaces of said insert.

* * * * *